United States Patent [19]

ajögren et al.

[11] Patent Number: 4,781,513

[45] Date of Patent: Nov. 1, 1988

[54] APPARATUS FOR UNLOADING BULK MATERIAL

[76] Inventors: Leif ajögren, Rosenberg Fly, S-411 81 Alingsås; Kjell A. Sjögren, Rensvist, S-447 00 Vårgårda, both of Sweden

[21] Appl. No.: 7,967

[22] PCT Filed: Apr. 14, 1986

[86] PCT No.: PCT/SE86/00172

§ 371 Date: Nov. 10, 1986

§ 102(e) Date: Nov. 10, 1986

[87] PCT Pub. No.: WO86/06119

PCT Pub. Date: Oct. 23, 1986

[30] Foreign Application Priority Data

Apr. 15, 1985 [SE] Sweden ..... 8501832

[51] Int. Cl.[4] ..... B05P 1/40

[52] U.S. Cl. ..... 414/489; 239/657; 239/659; 239/675; 414/501; 414/505; 414/526

[58] Field of Search ..... 239/652, 657, 659, 661, 239/664, 672, 675, 688, 689; 414/489, 501, 502–505, 523, 526

[56] References Cited

U.S. PATENT DOCUMENTS

| | | | |
|---|---|---|---|
| 2,182,139 | 12/1939 | Speno | 414/502 |
| 2,761,578 | 9/1956 | Brownlee et al. | 414/503 |
| 2,883,076 | 4/1959 | Palmer | 239/675 |
| 3,056,521 | 10/1962 | Marr | 414/489 |
| 3,189,355 | 6/1965 | Swenson et al. | 239/657 |
| 3,322,257 | 5/1967 | Phillips | 414/505 |
| 3,391,778 | 7/1968 | Lasiter | 414/504 |
| 3,923,175 | 12/1975 | Landvatter | 414/489 |
| 4,422,767 | 12/1983 | Yelton | 414/505 |

FOREIGN PATENT DOCUMENTS

| | | |
|---|---|---|
| 3034030 | 5/1982 | Fed. Rep. of Germany . |
| 2395859 | 1/1979 | France . |
| 407246 | 3/1919 | Sweden . |
| 473278 | 7/1969 | Sweden . |

*Primary Examiner*—Andres Kashnikow
*Assistant Examiner*—Michael J. Forman
*Attorney, Agent, or Firm*—Burns, Doane, Swecker & Mathis

[57] ABSTRACT

An apparatus for unloading bulk material, particularly asphalt and the like, from the deck (3) of a load-carrying vehicle, and spreading the material (49) over ground (37) contiguous to the vehicle, includes a spreader unit connectable for support to the rear end of the deck (3). The unit comprises a part (5) arranged for connection to the end of the deck for receiving material from the deck, and with the aid of a transverse conveyor (7) to give this material a suitably agitated or comminuted state and convey it further, and a cantilever arm-like conveyor (9), adapted at its first end to receive the material conveyed according to the above and at its second free end to discharge received material, the conveyor (9) being controllably swivelably suspended (at 11) at said first end, so that it can be caused to sweep over ground (37) contiguous to the vehicle, thereby to spread the discharged material (49) over said ground.

7 Claims, 5 Drawing Sheets

APPARATUS FOR UNLOADING BULK MATERIAL

TECHNICAL FILED

The present invention relates to an apparatus for unloading bulk material, particularly sticky or similar material such as asphalt, tarmacadam and the like, from the deck of a load-carrying vehicle and spreading the material over ground contiguous to the vehicle. The latter is typically a truck, but may also be a trailer provided with a load deck, or the like.

BACKGROUND ART

In larger projects, bulk material of the asphalt type and the like is generally deposited with the use of special, self-driven machines, which are fed with material directly by tipping from the deck of a load-carrying vehicle moving in front of the machine.

In depositing material on a comparatively smaller scale, or where conditions do not permit the use of machines of the type just mentioned, e.g. on garage ramps, footpaths, pavements, slopes etc, the material must be unloaded from the load-carrying vehicle and spread manually, i.e. with shovels handled by workmen. This job is very heavy and wearing (a workman may unload and spread more than 15 tons of material during a working day) and often gives permanent wear injuries, e.g. in the back and shoulders of the workman. There is thus a great need of some aid which could take over the actual work of unloading and spreading heavy bulk material from the workmen.

An asphalt spreader has been proposed (see SE-B-7602592-3) comprising an asphalt container carried on a truck deck, there being swingably connected to the rear outlet end of the container an arm-like discharge conveyor for spreading the material over contiguous ground when the material is discharged. The material is intended to be fed out from the container by gravity to the connecting conveyor end. The conveyor is carried in a special carriage, such as to allow the conveyor to be thrust in under the truck deck when the conveyor is not used. In other words, the entire asphalt spreader is intended to be mounted on a truck and accompany it the whole time, i.e. it is tied to a single truck. This type of asphalt spreader has not been found to function satisfactorily or with the necessary economy, and neither has it come to be actually used to any notable extent.

It has also been proposed (see CH-A-473278) to connect to a truck a smaller spreading apparatus running on its own wheels, which is fed by gravity with material from the truck deck and spreads out received material over contiguous ground by using feed screws and endless conveyors. The apparatus requires an extensive frame structure and releases the material to the ground from a comparatively great height, making the apparatus less flexible and comparatively difficult to operate, as well as impossible to use when difficultly-worked asphalt masses are used. Such materials may not, for example, be fed out with a large drop, since there is then obtained an unacceptable premature compression of the material.

OBJECT OF THE INVENTION

The object of the present invention is to provide an improved apparatus of the kind mentioned in the introduction, which may constitute an effective aid of the desired kind, which may furthermore be readily caused to coact with different load vehicles and which is easy to move between different working sites.

SUMMARY OF THE INVENTION

The above-mentioned object is achieved with an apparatus in accordance with the invention, which has the characterizing features disclosed in the accompanying claims. The apparatus in accordance with the invention is thus essentially distinguished in that it includes a spreader unit, connectable to the rear end of the deck of the loadcarrying vehicle for being carried thereby, said unit including (a) a connection part adapted for connection to the deck end, and receiving bulk material from the deck, and giving this material an agitated or broken-up condition suitable for further conveyance as well as conveying the material further, (b) a cantilevering arm-like conveyor adapted for receiving at its first end the material conveyed from the connection part, and at its free second end discharging the received material, the conveyor being controllably, pivotably suspended at its first end, so that it may be caused to sweep over ground contiguous to the loadcarrying vehicle, thus to spread the discharged material over the ground.

In other words, the spreader unit is adapted for being carried by the load-carrying vehicle deck, whereby it will be easily adjustable to different tipping positions of the deck, as well as readily adjustable and fastenable to different load-carrying vehicles. The connection part of the unit may thus be implemented in a general way as a tailboard, which rests on and/or is connected to the rear end edge area of the deck via a guide plate or similar guide element. The connection part may furthermore be brought against the vertical rear edges of the vehicle sideboards, thus closing off the opening allowing discharge from the deck. Locking on the connection part may be done in an option, suitable manner, e.g. by struts or the like attached to the outsides of the sideboards or the deck, whereby the guide plate or element is pressed down against the deck surface and the rest of the connection part is pressed against the rear edges of the sideboards. It will be understood that the connection part may very readily be mounted quite simply by being thrust into place from behind, e.g after having been lifted up by a crane on the load-carrying vehicle or from a lifted or raised position on a special transport trolley or its own support legs.

In accordance with a preferred embodiment of the invention, the connection part is arranged to join onto the deck via an adapter, which constitutes an extension and/or a termination of the deck. To advantage, such an adapter may also be arranged to constitute a low tail board, when the truck is disconnected from the spreader unit, e.g. in conjunction with collecting asphalt, As will be understood, the adapter can be fitted to the respective truck deck, and simultaneourly constitute a fixedly mounted adaption to the connection part, whereby connection of the spreader unit to different truck decks is facilitated. The adapter, which is thus suitably fixedly mounted on the truck deck and which suitably also has fixed side elements providing closure against the back edges of the sideboards and the mounted connection part, results in an extension over the drawbar hook of the load-carrying vehicle, whereby the tipping angle of the deck can be utilised to a maximum without risk of interference from the hook.

The connection part includes to advantage a transverse conveyor, which meets up with the rear deck edge when the spreader unit is connected, and is arranged transversely to convey material incoming or flowing in from the deck towards the deck edge to a material outlet, preferably situated at the centre of the deck edge for conveying further to the pivotable arm-like conveyor. This transverse conveyor is preferably arranged in direct connection to the previously mentioned rear part of the guide plate, i.e. in principle where the load deck ceases. To advantage, the conveyor is of the screw conveyor type, the portions of the screw on either side of the material outlet having opposing feed directions. The conveyor screw is preferably a full, cylindrical screw to give the desired comminuting or agitating effect. The material outlet is preferably arranged so that discharged material can fall freely down to an underlying inlet on the arm-like conveyor. In other words, it is advantageous not to have a fixed material discharge path between the connection part and the arm-like conveyor, since it will then be possible easily to allow the connection part and the armlike conveyor to have different mutually relative positions, as will be apparent below.

The arm-like conveyor is thus to advantage pivotably suspended in a suspension part, which is swivelable connected to the connection part, so that the relative position between the suspension part and the connection part can be controllably varied for adjusting to different deck tipping positions and thereby to different positions of the connection part. The suspension part is here suitably pivotable about a transverse shaft, which is at least substantially parallel to the transverse conveyor and deck rear edge. The suspension part can consequently be given a suitable substantially horizontal position (when the load carrying vehicle is on an in principle horizontal substructure) independent of the tipping attitute of the deck. The swiveling shaft for the arm-like conveyor may thus be readily kept substantially at right angles to the substructure i.e. vertical for a horizontal substructure.

In accordance with a preferred embodiment, the armlike conveyor is suspended at its material reception end in a ring means or the like, rotatable in the suspension part, such that the conveyor is pivotable about a substantially horizontal axis in relation to the ring means, the ring means being rotatably mounted in the suspension part so that the plane of the ring may be at least substantially horizontal in a position of normal use. The suspension part then has an opening corresponding to the ring opening so that in the position of use the above-situated material outlet from the transverse conveyor and the below-situated, preferably hopper-like material inlet to the arm-like conveyor is in line with this opening. There is thus ensured material flow into the material inlet to the arm-like conveyor independent of its pivoting position, and that the arm-like conveyor can be angled in a plane at right angles to the plane of the ring. Due to the latter, the arm-like conveyor may be caused to sweep in a plane forming an angle to the plane in which the load-carrying vehicle stands, without the setting of the suspension part needing to be changed. This gives good ability for adapting to ground which slopes in relation the ground or substructure on which the load-carrying vehicle stands. Such conditions occur, e.g. in depositing material on sloping garage ramps or slopes etc.

To give further adaptability to different ground inclinations etc in conjunction with the sweeping movement of the arm-like conveyor, the suspension thereof can be adjustable so that the axis about which the conveyor pivots in its sweeping movement when in use may be given different inclinations in a transverse plane which is preferably at least substantially vertical. This can be achieved in an advantageous manner by the suspension part in which the ring means or its counterpart is mounted, being adapted such as to enable it when in the position of use to be adjustably swung to an at least limited degree also about an axis which is at least substantially parallel to the longitudinal axis of the load-carrying vehicle.

The arm-like conveyor which preferably includes one or more feed screws, is to advantage articulated and has an outer part which is separately pivotable relative the rest of the conveyor. The arm-like conveyor can thus be caused to "go round" obstacles such as posts, trees etc.

Hydraulic motors are used to advantage for driving the respective conveyors, the necessary hydraulic pressure being obtainable from the hydraulic system of the load-carrying vehicle. The different controllable pivoting and adjusting movements of the parts included in the spreader unit can also be performed suitably by allowing the hydraulic pressure from the vehicle hydraulic system to actuate hydraulic cylinders and/or motors. The necessary control system for participating hydraulic motors and cylinders can be supplied with current from the electrical system of the vehicle. Consequently the apparatus in accordance with the invention does not need any power sources of its own.

The invention will now be described in more detail with the aid of an embodiment and with reference to the accompanying drawings.

DESCRIPTION OF EMBODIMENT

Figure 1:
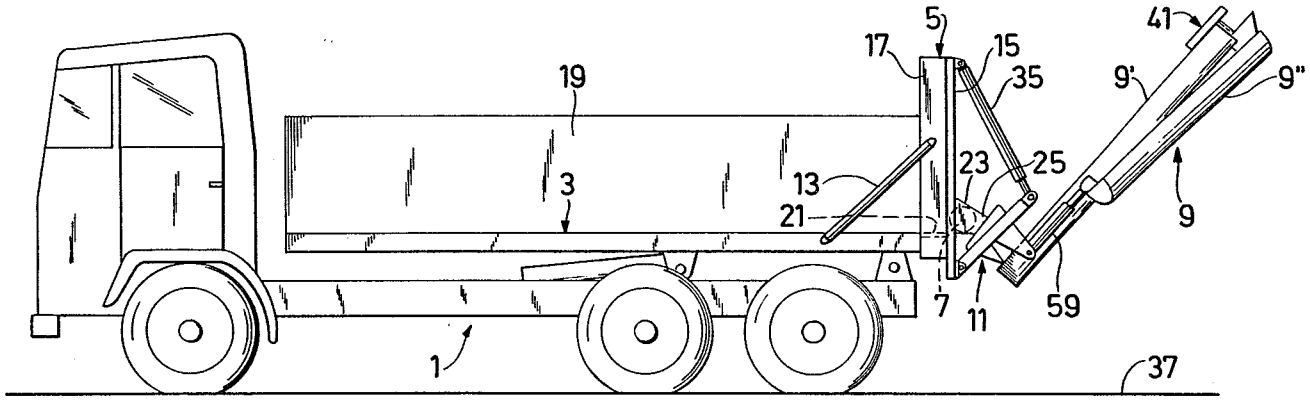
FIG. 1 is a schematic side view of an apparatus in accordance with the invention mounted on a truck, the armlike conveyor being retracted and lifted, i.e. it is in a condition suitable for transport on the truck.

In the following description it is assumed that the truck is on a flat horizontal substructure, statements as to the direction of axes, shafts and planes being related thereto.

The implementation and arrangement in general of an apparatus in accordance with the invention will first be described with reference to FIGS. 1–3. The apparatus shown therein is mounted on the load deck 3 of a truck 1, and includes three main parts, namely a connection part 5 including a transverse screw conveyor 7, an arm-like cantilever conveyor 9, and a suspension part 11 for the conveyor 9, said part being in turn suspended in the connection part 5. The connection part 5 is fixedly mounted on the deck 3 at the rear end of the latter. The connection part has the character of a tailboard which has been fastened to the deck end with the aid of tensionable side struts 13. The connection part thus includes a tailboard plate 15 having forwardly projecting side guide elements 17 arranged at its side edges, for connection to the outside of the deck sideboards 19. Downwards on the tailboard 15 there is a forwardly projecting support and guide plate 21 resting on, and mating up with the rear end area of the deck surface. The side struts 13 are fastened to the upper part of the side guide elements 17 and extend slopingly downwards into engagement with the deck 3. It will be understood that the connection part 5 may thus be easily applied to any deck end of suitable size, without needing other modifications or operations than the arrangement of suitable fastening points on the deck for the lower ends of the side struts 13.

It will be further understood that the side guide elements 17 are advantageous but not necessary. Without such elements there will naturally be less demand on suiting the width of the connection part 5 to the load deck 3, as long as the support and guide plate 21 is not wider than the deck surface itself between the sideboards 19. However, the plate 21 does not need to extend over the entire deck width or be continuous.

Where the tailboard 15 connects to the deck end, it is provided with a transverse opening into a transverse conveyor space lying behind it, which is defined by an outwardly curved casing plate 23 behind this space. A screw conveyor 7 is arranged in this space. As will be understood, the conveyor 7 receives material which flows rearwards-downwards when the deck (FIG. 2) is tipped, the material comning into the conveyor via the opening. Rearwards and at the middle thereof, a material outlet 25 is arranged at the plate 23. The outlet is directed slopingly downwards-rearwards. The screw conveyor 7 is divided into two parts. These parts 7′ and 7″ each feed material towards the centre and towards the outlet 25, i.e. their screw movements are in opposite directions. The conveyor 7 is driven by a side-mounted hydraulic motor 27.

Figure 2:
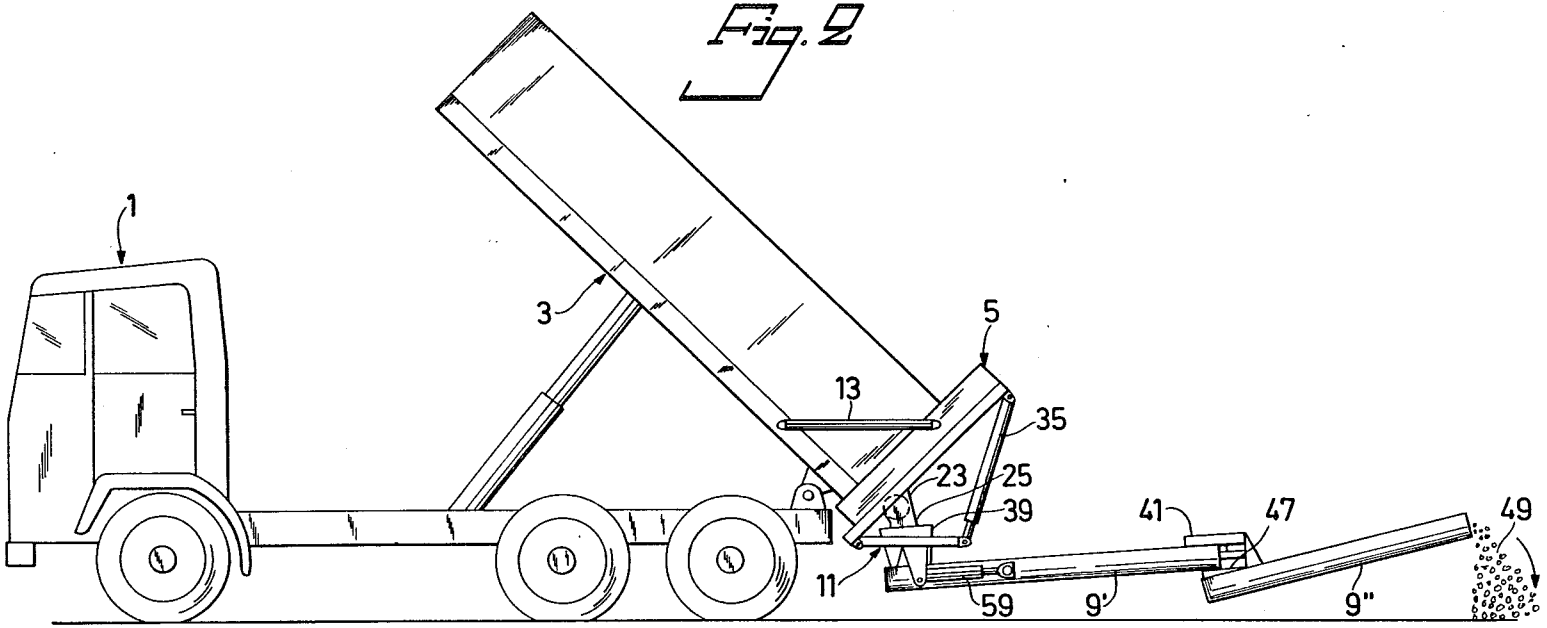
FIG. 2 is a schematic side view of the truck with the apparatus according to FIG. 1, although the deck of the truck has been tipped for unloading material and the arm-like conveyor is extended and lowered in its material spreading attitude.
Figure 3:
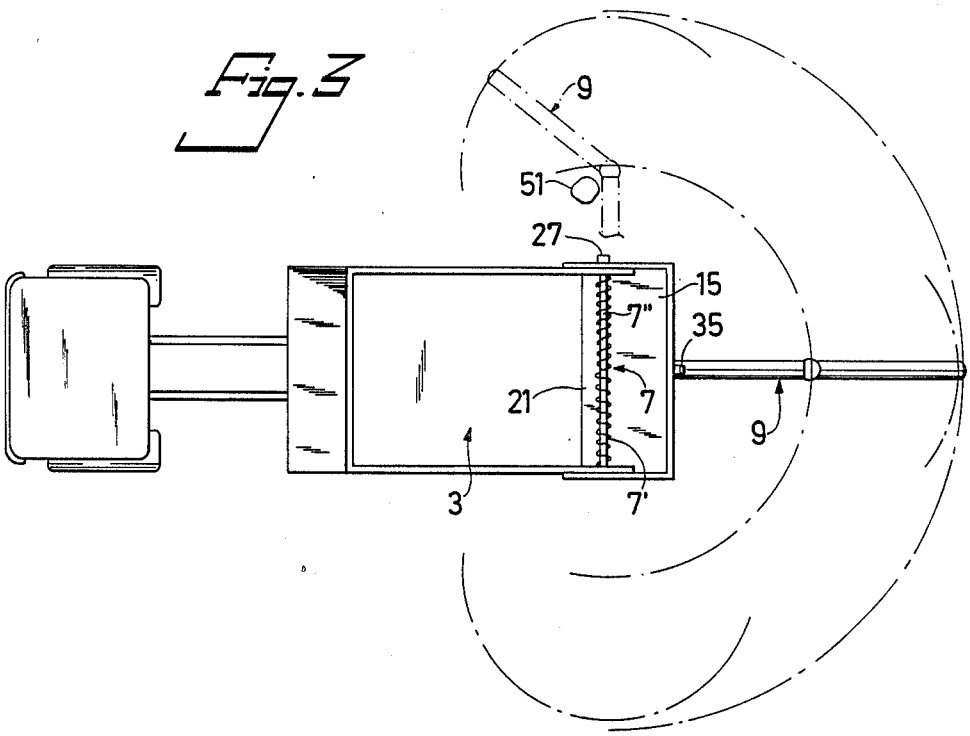
FIG. 3 is a schematic view seen from above of the truck and the apparatus in accordance with the invention in the condition shown in FIG. 2, this view illustrating the swiveling facility of the arm-like conveyor.

The suspension part 11 includes a platform or plate 31, situated rearwards of the deck edge, and which is forwardly, hingedly connected to the lower part of the tailboard 15 (at 33) so that the platform 31 is pivotable about an axis parallel to the deck edge (horizontal in FIGS. 1–3). One end of a hydraulic cylinder 35 is pivotably connected to the middle of the rear edge of the platform. The other end of the cylinder 35 is pivotably connected to the tailboard 15 at the middle of its upper edge. It will be understood that the platform 31 can thus be readily given a desired position relative the connection part 5 and underlying ground 37 by regulating the length of the cylinder 35 (see also FIG. 4).

Figure 5:
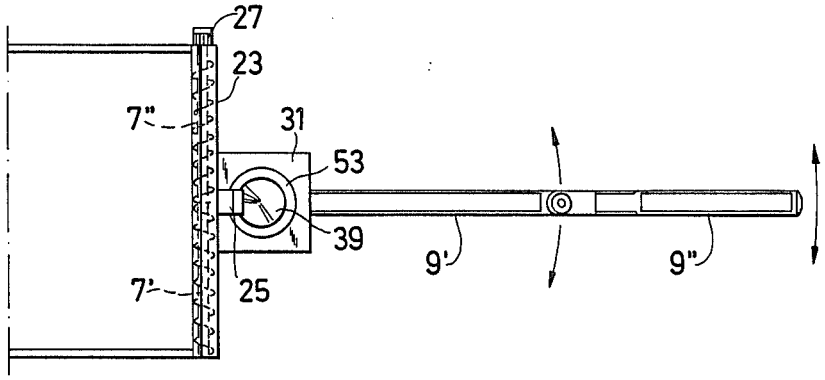
FIG. 5 is a schematic view seen from above of the arrangement according to FIG. 4, with certain parts removed for further illustrating the suspension of the arm-like conveyor.

The intake end of the conveyor 9 is controllably, rotatably suspended centrally in the platform 31, as will be described in more detail later with reference to FIGS. 4 and 5. At its intake end the conveyor 9 is provided with an upwardly directed hopper 39 arranged for receiving free-falling material discharged from the outlet 25.

The conveyor 9 is in two parts, 9′ and 9″, which are connected to each other (at 41) so that the outer part 9″ can be swung under control and unhindered relative the inner part 9′. In principle, each conveyor part 9′ and 9″ is tubular and includes a continuous-flight screw conveyor driven by its respective hydraulic motor 43 or 45 (see FIG. 4). The discharge end of the conveyor part 9′ normally feeds the intake of the part 9″, but suitably it can be arranged such as also to discharge the material directly on the underlying ground 37.

The normal working attitude of the apparatus in accordance with the invention is illustrated in FIG. 2. The truck deck 3 is tipped up, so that the material on it, such as asphalt or macadam, flows rearwards and downwards towards the transverse conveyor 7. This discharges the material in suitably porous or comminuted form through the outlet 25. The suspension platform 31 is given an at least substantially horizontal attitude, i.e. parallel to the ground 37, resulting in that the conveyor 9, in its working attitude substantially along the ground, has its intake hopper 39 directly under the outlet 25. The material is fed from the outlet 25, through the first conveyor part 9′ and out through its outlet and down into the intake of the other conveyor part 9″ through the part 9″ and finally out through its outlet, the material falling down onto the ground (indicated at 49 in FIG. 2) in a form such that supplementary spreading, e.g. with an asphalt rake, will be simple to carry out.

As illustrated in FIG. 3, spreading is enabled over a very large area, due to the conveyor part 9′ being swiveable about a substantially vertical axis pertaining to the platform 31 and due to the outer conveyor part 9″ being enabled to swivel unobstructed about a substantially vertical axis at the discharge end of the conveyor part 9′ in any position of the latter. This extra swivelling movement enables getting round different kinds of obstruction, such as a post or a tree. This is exemplified at 51 in FIG. 3.

It should be emphasised that mounting the conveyor 9 freely behind the deck end results in that its swivelling area can be made very large, in general considereably greater than 180°, e.g. 270°.

The suspension of the conveyor 9 in the platform or plate 31 will now be more closely described with reference to FIGS. 4 and 5.

A ring 53 is rotatably mounted centrally in the platform 31 in a corresponding circular hole therein. The plane of the ring substantially coincides with the plane of the platform and the ring means is controlably rotatable about an axis at right angles to the planes of ring and platform, i.e. about an axis extending vertically in FIG. 4. The intake end of the conveyor 9 is pivotably mounted on the ring 53 with the aid of two suspension elements 55. These are downwardly rigidly connected to the conveyor 9 on either side thereof and are upwardly articulately connected to the ring 53 in two diametrically opposing positions, so that at their upper ends the elements 55 are pivotable about an axis parallel to the planes of the ring 53 and platform 31, i.e. about a horizontal axis in FIG. 4. This axis is indicated at 57.

Figure 4:
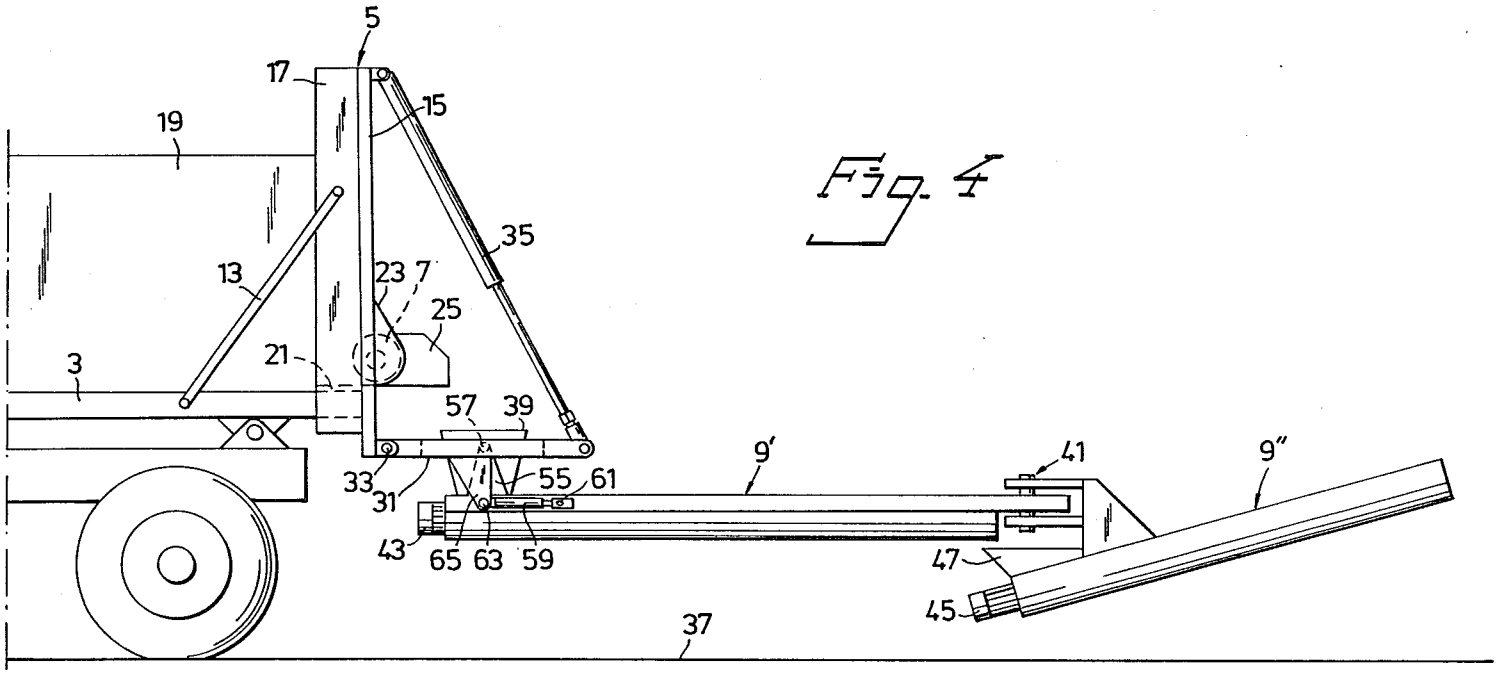
FIG. 4 is a schematic somewhat enlarged and more detailed side view of an apparatus in accordance with the invention mounted on a load deck, further to illustrate the construction of an apparatus in accordance with the invention.

As will be easily understood, this suspension means that the conveyor 9 can readily be pivoted in a plane at right angles to the plane of the platform 31, i.e. for movement in a vertical plane in FIG. 4. The attitude of the extended conveyor 9 over the ground 37 can thus be regulated, e.g. for adjusting to ground sloping in relation to the ground on which the truck is standing.

To controllably regulate the slope of the conveyor 9 in accordance with the above, slope regulating hydraulic cylinders 59 are arranged one on either side of, and along the conveyor 9. One end of each cylinder 59 is pivotably connected to the conveyor (at 61). The other end is (at 63) pivotably connected to fixed elements 65 projecting downwards on either side of the platform 31. A change in the working length of the cylinders 59 changes the angular attitude of the conveyor 9 relative the platform 31.

The intake hopper 39 extends upwards through the opening in the platform 31 with play to the platform such that the pivoting movement of the conveyor 9 about the abovementioned horizontal axis is not obstructed. When the deck 3 is tipped, the material outlet 25 may extend down to and possibly into the hopper 39. The latter facility is also utilised when the apparatus is in a raised and retracted transport attitude, as is illustrated in FIG. 1.

The controlled rotation of the ring 53 and thereby the swiveling movement of the conveyor 9 above the ground 37 can suitably be provided by an unillustrated hydraulic motor. This may be mounted on the platform 31 and can be connected to the ring 53 via a driving chain, gear transmission or in some other suitable manner, which ought to be obvious to one skilled in the art.

The swivelling movement of the outer conveyor part 9″ about the shaft 41 may be performed manually, in which case a suitable handle or the like is arranged on the conveyor part, or by a hydraulic motor suitably arranged at and connected to the shaft 41.

If further flexibility is desired with respect to adjustment facilities on the cantilever conveyor 9, the platform 31 may also be made swivelable relative the tailboard 15 about an axis which is principly at right angles to the transverse pivoting axis of the platform. This further axis only needs to enable limited movement. A modification of the connection of the platform to the transverse pivoting axis adapted to this must naturally be carried out, as one skilled in the art will understand. A double adjustment facility of this kind for the platform 31 enables, for example, compensating the situation where the load-carrying vehicle is standing on an angle on a substructure, i.e. has an attitude such that the plane of the untipped deck is not parallel to the ground plane.

Figure 6:
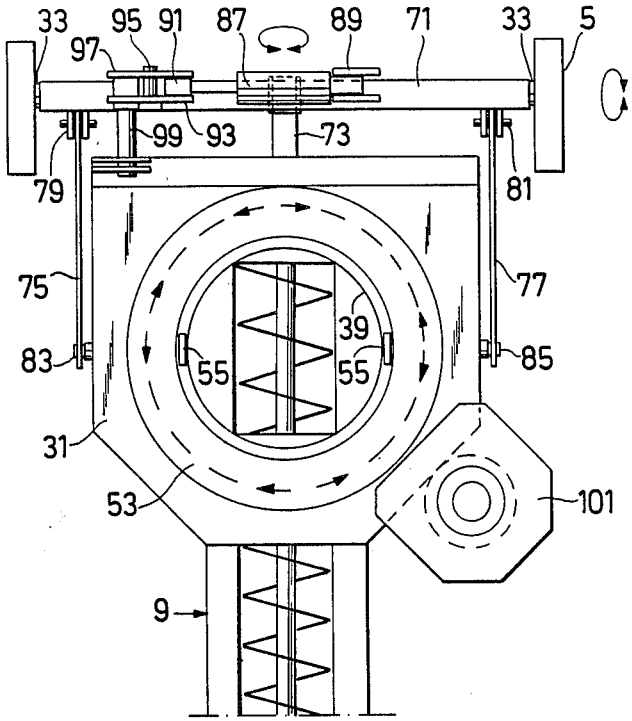
FIG. 6 is a schematic partial view from above of a suspension of the arm-like conveyor, this suspension allowing pivoting about two different axes at right angles to each other.

In a schematic view from above it is depicted in FIG. 6 how the platform 31 can be mounted pivotable about two axes at right angles to each other. The actual platform 31 is here suspended in a transverse beam 71, constituting the transverse pivoting shaft with its previously mentioned bearings 33. The suspension in the transverse beam includes a journalling stub 73 which projects "longitudinally" from the centre of the front edge of the platform 31 and which is journalled in the transverse beam 71 and constitutes the actual longitudinal pivoting shaft, i.e. the pivoting axis at right angles to the transverse pivoting axis. The suspension further includes two side struts 75 and 77. The front ends of these struts are respectively mounted on the transverse beam 71 at 79 and 81. the mounting axis being parallel to the transverse pivoting axis. The rear ends of the struts are mounted on the side edges of the platform 31 at 83 and 85, using universal joints so that a minor pivoting movement of the platform 31 about the axis 73 can be taken up. Pivoting of the platform 31 about the axis 73 is regulated by a hydraulic cylinder 87, lying in a plane through the transverse beam 71, said plane being at right angles to the plane defined by the transverse and longitudinal pivoting axis. One end of the cylinder is mounted at 89 on the transverse beam 71 and the other piston rod end is mounted at 91 in one upper corner of a connection link 93. The latter has a substantially triangular shape in the vertical plane, with one apex downwards. This apex is mounted at 95 on the transverse beam 71. A transfer pin 99 is mounted in the link 93 at its other upper corner 97. The other end of the pin 99 is mounted on the platform 31 at one forward corner thereof. The axis of the pin 99, as are the axes of the mountings for the pertinent regulating mechanism are parallel to the longitudinal axis, as will be understood. It will be further understood that by changing the projecting length of the piston rod of the cylinder 87 the platform 31 may be urged to pivot about the stub 73, independent of the pivoting position about the transverse beam 71.

It has been indicated at 101 in FIG. 6 how a hydraulic motor for the previously mentioned rotation of the ring 53 may be arranged.

Figure 7:
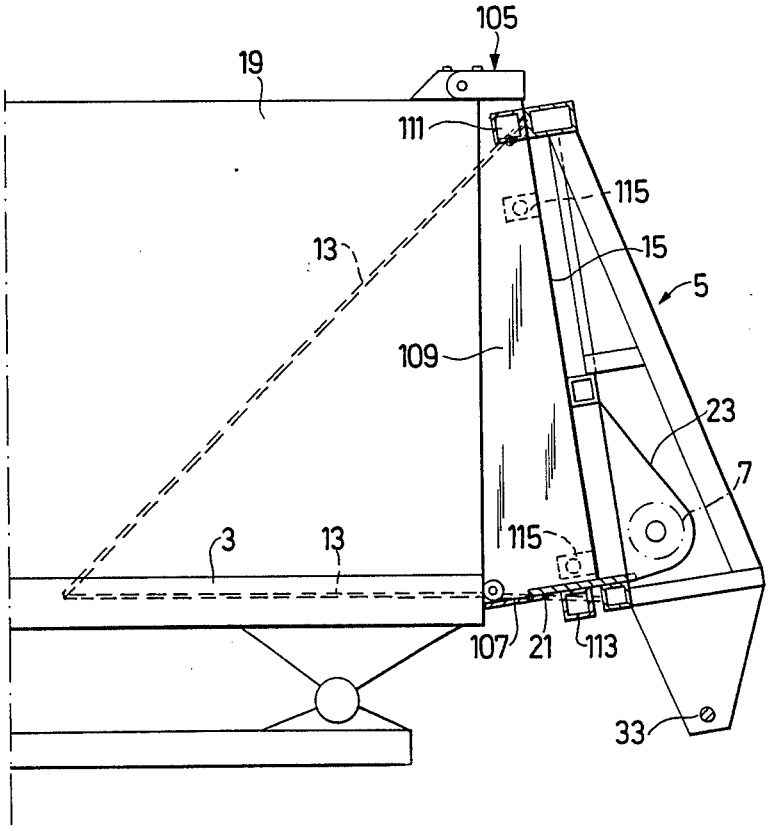
FIG. 7 is a schematic partial side view illustrating the connection of an inventive apparatus to a truck deck with the utilisation of an adapter.

An embodiment of the invention is illustrated in FIG. 7, in which the spreader unit connection part 5 is connected to the truck deck 3 via an adapter 105 rigidly mounted on the deck. The adapter comprises a low tailboard part 107, which is downwardly mounted and can be swung rearwards, thereby to constitute an extension of the deck, as indicated in FIG. 7, and side closure plates 109, one on either side of, and joining up to the side boards 19. Between the plates there is an upper and a lower transverse beam 111 and 113, respectively. The lower beam 113 also constitutes a stop for the tailboard part 107, when this is swung down rear-wards. The stop is placed such that the tailboard part 107, which has a height of about 20 to 25 cm (or "length" when swung down), slopes somewhat upwards relative the deck, typically about 10°–15° in its rear-wardly swung position. This has been found to facilitate secure and well balanced material discharge.

Fitting the connection part 5 takes place substantially as described previously, although the guide plate 21 is applied to the rearwardly swung tailboard part 107 and the tail plate 15 joins on to the rear edges of the plates 109. Locking in position takes place with the aid of locking means 115 on the plates 109, and as previously, with the tensionable struts 13 to the deck 3.

Although a preferred embodiment of the apparatus in accordance with the invention has been illustrated and described, the invention is, of course, not limited thereto and alterations and modifications are possible within the scope of the following claims.

We claim:

1. An apparatus for unloading bulk material from a load-carrying vehicle deck and spreading the material over ground contiguous to the vehicle, the apparatus comprising a spreader device, connectable to a rear end of the deck and carried thereby during unloading of the material, said spreader device comprising an adapter fixedly mounted on the rear end of said deck, and a spreader unit connectable to said adapter on said vehicle at a work site for unloading the material from the deck of said vehicle, said spreader unit comprising a connection part, means for connecting the connection part to said adapter on the vehicle, said connection part including means for receiving the material from the deck and giving the material an agitated condition suitable for further conveyance, said means for receiving the material including a transverse conveyor connected to a rear edge of the deck when the spreader unit is connected to said adapter, for conveying bulk material to a material outlet of the connection part, an extensible cantilever conveyor having a first material inlet end for receiving the bulk material discharged through said material outlet of the connection part and falling freely therefrom to the cantilever conveyor and a discharge end for discharging bulk material to be spread out, the cantilever conveyor being articulated and having an outer part separately pivotable relative to the cantilever conveyor, so that said outer part is movable over the ground relative to the cantilever conveyor, a suspension part connected to the connection part and being pivotable around a transverse shaft such that the pivotable attitude between the suspension part and the connection part is controllably changeable for adjusting to different positions of the deck and to different positions of the connection part, whereby the suspension part is at least substantially parallel to the ground when the material is being spread, means for swivelably suspending the cantilever conveyor at its said first end in said suspension part, said means including a ring means from which the cantilever conveyor is suspended, said ring means being rotatably mounted in said suspension part such that when said ring means are rotated, the cantilever conveyor moves over the ground, said ring means having a ring opening and said suspension part having a corresponding opening, such that when the material is passing the material outlet of the connection part, said openings and the material inlet of the cantilever conveyor are in alignment; and means for adjusting the suspension of the cantilever conveyor such that an axis about which the conveyor swivels in its sweeping movement can be given various inclinations in a transverse plane relative to the vehicle.

2. An apparatus as claimed in claim 1, wherein the cantilever conveyor, suspended in said ring means is pivotable around the axis at least substantially parallel to a plane of said ring means.

3. An apparatus as claimed in claim 2, wherein said means for adjusting the suspension of the cantilever conveyor comprises means for adjustably pivoting the suspension part about an axis which is at least substantially parallel to a longitudinal axis of the vehicle.

4. An apparatus as claimed in claim 2, wherein said adapter includes a downwardly mounted rearwardly swingable tailboard part which, when in a rearwardly swung position, together with the connection part, constitutes an extension of the deck which ends at said transverse conveyor.

5. An apparatus as claimed in claim 1, wherein said means for adjusting the suspension of the cantilever conveyor comprises means for adjustably pivoting the suspension part about an axis which is at least substantially parallel to a longitudinal axis of the vehicle.

6. An apparatus as claimed in claim 5, wherein said adapter includes a downwardly mounted rearwardly swingable tailboard part which, when in a rearwardly swung position, together with the connection part, constitutes an extension of the deck which ends at said transverse conveyor.

7. An apparatus as claimed in claim 1, wherein said adapter includes a downwardly mounted rearwardly swingable tailboard part which, when in a rearwardly swung position, together with the connection part, constitutes an extension of the deck which ends at said transverse conveyor.

* * * * *